US006065831A

United States Patent [19]

Kawaura et al.

[11] Patent Number: 6,065,831

[45] Date of Patent: May 23, 2000

[54] INK JET PRINTER WITH REPLACEABLE INK CARTRIDGES

[75] Inventors: Masafumi Kawaura, Nagoya; Masaaki Hori, Tajimi, both of Japan

[73] Assignee: Brother Kogyo Kabushiki Kaisha, Nagoya, Japan

[21] Appl. No.: 08/911,007

[22] Filed: Aug. 14, 1997

[30] Foreign Application Priority Data

Aug. 19, 1996 [JP] Japan ..... 8-217109

[51] Int. Cl.[7] ..... B41J 29/13

[52] U.S. Cl. ..... 347/108

[58] Field of Search ..... 347/5, 9, 23, 108

[56] References Cited

U.S. PATENT DOCUMENTS

| | | | |
|---|---|---|---|
| 5,504,513 | 4/1996 | Nobel et al. | 347/87 |
| 5,627,572 | 5/1997 | Harrington, III et al. | 347/23 |
| 5,786,842 | 7/1998 | Awai et al. | 347/217 |

OTHER PUBLICATIONS

Laser Class 700/7500 Plain Paper Facsimile Instruction Book, pp. 22–25, 1993.

*Primary Examiner*—John Barlow
*Assistant Examiner*—Michael S Brooke
*Attorney, Agent, or Firm*—Oliff & Berridge, PLC

[57] ABSTRACT

An ink jet printer comprises an ink jet print head with detachable ink cartridges, a carriage holding the print head, a controller for controlling their actions, and an outer case having an opening formed for detachment of the ink cartridge and mounting of a new ink cartridge. To the outer case, a manual operation key and an opening/closing cover for closing the opening are attached. The opening and closing of the opening/closing cover are detected by a sensor. The manual operation key has two action modes. When the opening/closing cover is opened, the controller switches the action modes from a sheet feed mode to a mode for moving the carriage to a region opposed to the opening for detachment of the ink cartridge and mounting of a new ink cartridge. The number of operation keys is decreased, and key operation becomes easy. A display of an action is made on the outer case and the opening/closing cover so that each action can be known whether the opening/closing cover is open or closed.

14 Claims, 11 Drawing Sheets

INK JET PRINTER WITH REPLACEABLE INK CARTRIDGES

BACKGROUND OF THE INVENTION

1. Field of the Invention

The present invention relates to an ink jet printer, especially an ink jet printer which facilitates a key operation necessary for a replacement action for any of ink cartridges mounted on a carriage.

2. Related Art of the Invention

Generally, an ink jet printer with ink cartridges mounted on a carriage has an opening formed in an outer case over the entire range of movement of the carriage. When any of the ink cartridges is to be replaced, the old ink cartridge can be detached from, and a new one can be mounted on, the carriage through the opening. For replacement of the ink cartridge, the carriage mounted with all ink cartridges and a print head is moved to a position opposed to a part of the opening.

After the ink cartridge is replaced, a purging treatment for sucking ink from the print head side by use of a negative pressure must be performed to guide ink in the new ink cartridge to the print head.

The carriage movement and purging treatment before and after replacement of the ink cartridge, respectively, are carried out by operating keys provided on a printer body by a user. This type of printer, however, is limited in the number of operation keys to save the manufacturing cost, and assigns a plurality of functions to a single key. Thus, key operation includes a complicated task of, say, pushing two keys simultaneously, raising the possibility of a wrong operation. The user has to do such a complicated task while consulting a manual, and finds it tiresome.

SUMMARY OF THE INVENTION

The present invention has been accomplished to eliminate the foregoing drawbacks of the earlier technologies. An object of the invention is to provide an ink jet printer which is produced at reduced manufacturing costs, and which facilitates a key operation necessary for an action such as replacement of the ink cartridge.

A first aspect of the present invention is to provide an ink jet printer, comprising:

an ink jet print head with detachable ink cartridges;

a carriage holding the print head and movable along the surface of a printing sheet;

an outer case of the ink jet printer for accommodating the carriage over the range of its movement, and having an opening for detachment of the ink cartridge from the carriage and mounting of a new ink cartridge thereon, the opening being formed in the outer case so as to be opposed to a part of the range of movement of the carriage;

an opening/closing cover mounted on the outer case for covering the opening of the outer case;

a first detector for detecting the opening and closing of the opening/closing cover;

a control device for controlling the actions of the ink jet printer; and a manual operation key for entering an action signal for the ink jet printer into the control device; wherein two or more action modes are allocated to the manual operation key, and the control device switches the action modes of the manual operation key in response to a detection signal from the first detector which shows the opening or closing of the opening/closing cover.

Usually, a user opens the opening/closing cover when performing maintenance, inspection, or replacement of a part accommodated in the outer case, such as the ink cartridge or print head. Thus, an operation key mounted on the outer case can be assigned a mode for commanding the control device to take an action to be performed when the opening/closing cover is opened, and a mode for commanding the control device to take an action to be performed when the opening/closing cover is closed. As a result, the control device can switch these modes from one to the other responsive to the opening or closing of the opening/closing cover. By so constructing the operation key and the control device, it becomes possible to decrease the number of operation keys as well as the number of operations for the operation keys, thereby reducing the manufacturing costs for the ink jet printer and facilitating the key operations.

Among the actions to be performed when the opening/closing cover is opened, there are an action for moving the carriage to a part opposed to the opening of the outer case for the replacement of the ink cartridge, and an action for turning on or off the power supply or the input to the printer for the replacement of the print head. According to the ink jet printer of the present invention, the opening for detachment and mounting of ink cartridge is formed in the outer case so as to be opposed to a part of the range of movement of the carriage. That is, when the ink cartridge is to be replaced, the carriage holding the print head is moved to a region opposed to the opening, and replacement work can be done through this opening. The opening can be formed over the range where the carriage is moved for printing, namely, over a range approximately equal to the width of the sheet (see FIG. 2). This configuration facilitates replacement work. In the absence of the print action, the carriage holding the print head can be located at a region corresponding to the outside of the opening, i.e., the region covered with the outer case. Hence, when opening the opening/closing cover, the user does not inadvertently touch the print head or the carriage, except at the time of replacement of the ink cartridge.

Assume, for instance, that when the opening/closing cover is open, the action mode of the operation key is assigned the action for moving the carriage from the region covered with the outer case into the region opposed to the opening. In this case, the following operation is performed: While the ink jet printer is not performing a print action, the carriage is on standby or at a standstill in the region covered with the outer case. When the operation key is turned on while the opening/closing cover is open, the carriage is moved from the region covered with the outer case into the region opposed to the opening, where the user can replace the ink cartridge. When the opening/closing cover is closed after replacement of the ink cartridge, the action mode of the operation key is switched by the control device to an action originally required of the printer, such as a sheet feed action or an on/off action for the power supply.

The ink jet printer of the present invention may include a purging device having a cap making intimate contact with the print head and adapted to suck ink from ejection nozzles of the print head through the cap. The purging device can be located opposite that region of the carriage which is covered with the outer case. Thus, when the print head is at the wait or stop position, the print head is covered with the cap of the purging device to prevent the drying of ink in the nozzles. Since the print head and the carriage are covered with the outer case, moreover, the user cannot inadvertently touch the print head. This prevents the user from inadvertently moving the carriage to release the capping of the print head by the purging device and dry the print head.

When the operation key, assigned the action for moving the carriage from the region covered with the outer case into the region opposed to the opening during the opening of the opening/closing cover, is turned on, the control device can switch the operation key to the action mode for moving the carriage into the region covered with the outer case and then performing a purging operation by the purging device.

In the ink jet printer of the present invention, a through hole can be formed at that position of the opening/closing cover corresponding to the operation key so that the user can operate the operation key even when the opening/closing cover is in a closed state. The action mode of the operation key when the opening/closing cover is in a closed state can be displayed on the opening/closing cover, while the action mode of the operation key when the opening/closing cover is in an open state can be displayed on the outer case. By so constituting the outer case and the opening/closing cover, it becomes possible to carry out the predetermined mode easily whether the opening/closing cover is open or closed, and it becomes unnecessary for the user to refer to the manual or the like for each action, or to memorize the key operation for each action.

Furthermore, the inventive ink jet printer may include a second detector for detecting the remaining amount of ink in the ink cartridge, and a display instrument for displaying the results of detection by this detector on the outer case. A see-through hole can be formed at that position of the opening/closing cover which corresponds to the display instrument so that a display of the display instrument can be seen even when the opening/closing cover is closed. By so constituting the opening/closing cover, a decrease in the remaining amount of ink can be noted easily whether the opening/closing cover is open or closed. Thus, replacement work for the ink cartridge becomes easy. If the ink jet printer is a color ink jet printer, the provision of the second detectors and display instruments in the numbers corresponding to the colors of ink in a plurality of ink cartridges makes it easy to replace the cartridge of the required ink color.

A portion of the outer case which corresponds to the region covered with the outer case in the region of movement of the carriage can be composed of an openable/closable cover member. When the print head is covered with the cap of the purging device, or when the purging treatment is performed, therefore, the closure of the cover member prevents the user from touching the cartridge or the print head. Only when work such as the replacement of the print head or the maintenance of the purging device is required, the cover member is opened.

PREFERRED EMBODIMENTS OF THE INVENTION

An ink jet printer embodying the present invention will now be described with reference to the accompanying drawings.

Figure 1:
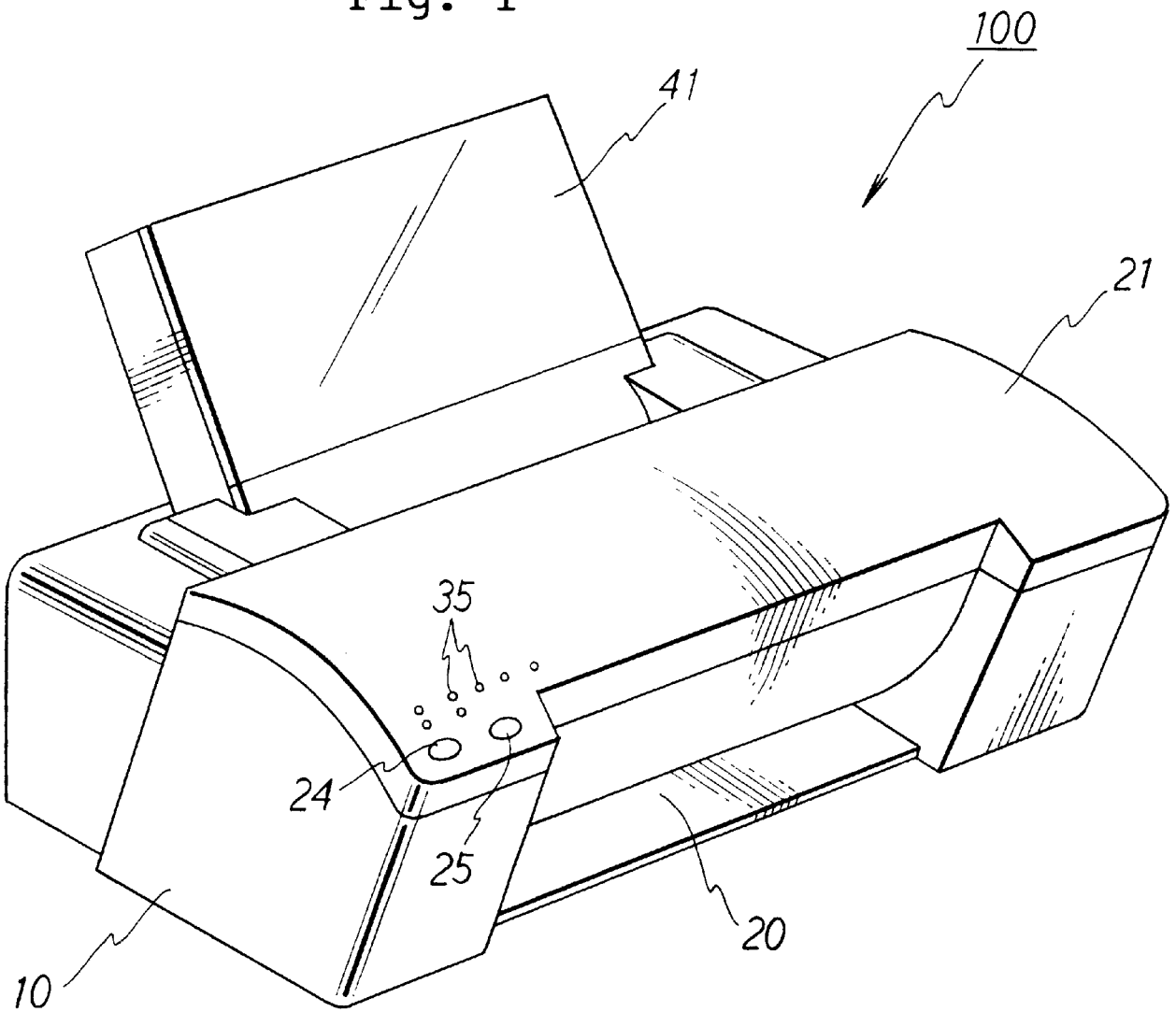
FIG. 1 is an outside perspective view of an ink jet printer of an embodiment of the present invention.
Figure 2:
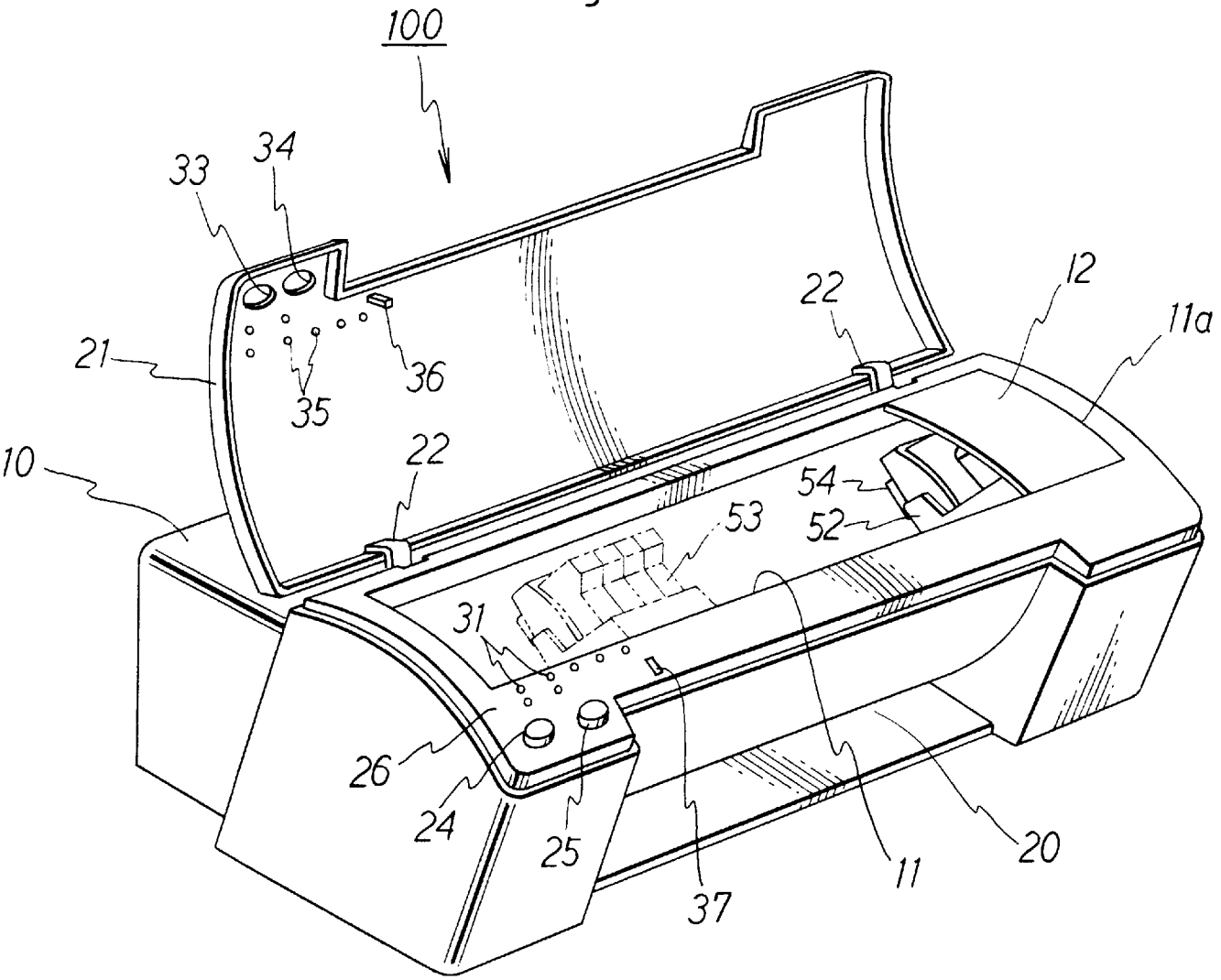
FIG. 2 is a perspective view of the ink jet printer in which an opening/closing cover is open.

FIG. 1 is an outside perspective view of an ink jet printer. An ink jet printer 100 has an outer case 10, and an opening/closing cover 21, which is openable and closable on the top of the outer case 10. By opening the opening/closing cover 21, as shown in FIG. 2, an ink cartridge can be replaced. At a front surface of the outer case 10, a discharge port 20 is formed for discharging a printed sheet. Above and at a rear part of the outer case 10, a sheet cassette 41 is mounted.

Next, the internal structure of the ink jet printer 100 will be described with reference to FIG. 3, a vertical sectional view of the ink jet printer 100 shown in FIG. 1.

Figure 3:
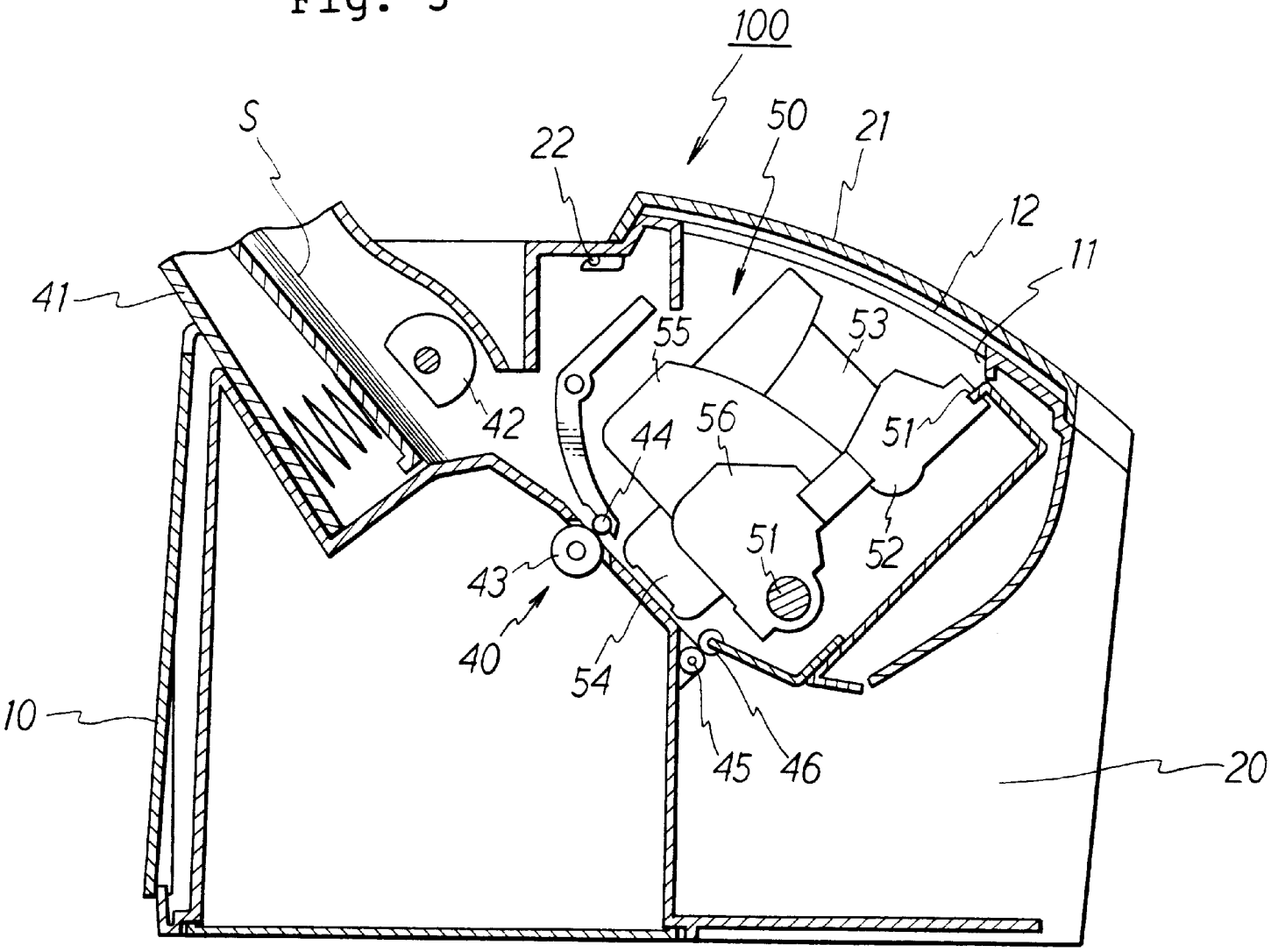
FIG. 3 is a vertical sectional view of the ink jet printer.

As shown in FIG. 3, the printer 100 is constructed such that a printing sheet S is conveyed to a front surface of a printing mechanism 50 by a feeding mechanism 40, given a predetermined print, and discharged through the discharge port 20. The printing sheet S is a rectangular cut sheet of constant dimensions.

The feeding mechanism 40 comprises a sheet cassette 41 accommodating many printing sheets in a stacked condition, a sheet feed roller 42 for feeding the printing sheets one by one from the sheet cassette 41, a pair of conveying rollers 43, 44 positioned upstream from the printing mechanism 50, and a pair of discharge rollers 45, 46 positioned downstream from the printing mechanism 50. The printing sheet S fed from the sheet cassette 41 has a front end registered by the conveying roller pair 43, 44. Then, the printing sheet S is sent by the conveying roller pair 43, 44 to a position opposed to the printing mechanism 50, and fed in a predetermined amount each time the printing mechanism 50 prints one line. The so printed printing sheet S is discharged by the discharge roller pair 45, 46 through the discharge port 20. A passageway defined between the roller pairs 43, 44 and 45, 46 of the feeding mechanism 40 is inclined downwardly forward at an angle of nearly 45 degrees.

The printing mechanism 50 is composed of a carriage 52 moving in a reciprocating manner along guide rails 51, and ink cartridges 53 and a print head 54 supported on the carriage 52. The guide rails 51 are disposed in the width direction of the printing sheet S fed by the feeding mechanism 40, namely, in a direction parallel to the surface of the printing sheet S and perpendicular to the direction of feeding of the printing sheet S. During printing, the print head 54 prints characters or graphics on the printing sheet S while the carriage 52 is being driven in a reciprocating manner by a drive source (e.g. a motor). The print head 54 is of an ink jet type which ejects ink droplets from its ink ejection nozzles toward the printing sheet S passing below. The ink cartridges 53 accommodate ink to be supplied to the print head 54. The instant embodiment is a printer capable of color printing, and the ink head 54 has ink ejection nozzles corresponding to different colors. The ink cartridges 53 are present for different colors. The print head 54 and the ink cartridges 53 are placed downwardly obliquely at an angle of nearly 45 degrees so that the ink ejection nozzles face the passageway at right angles.

Figure 9:
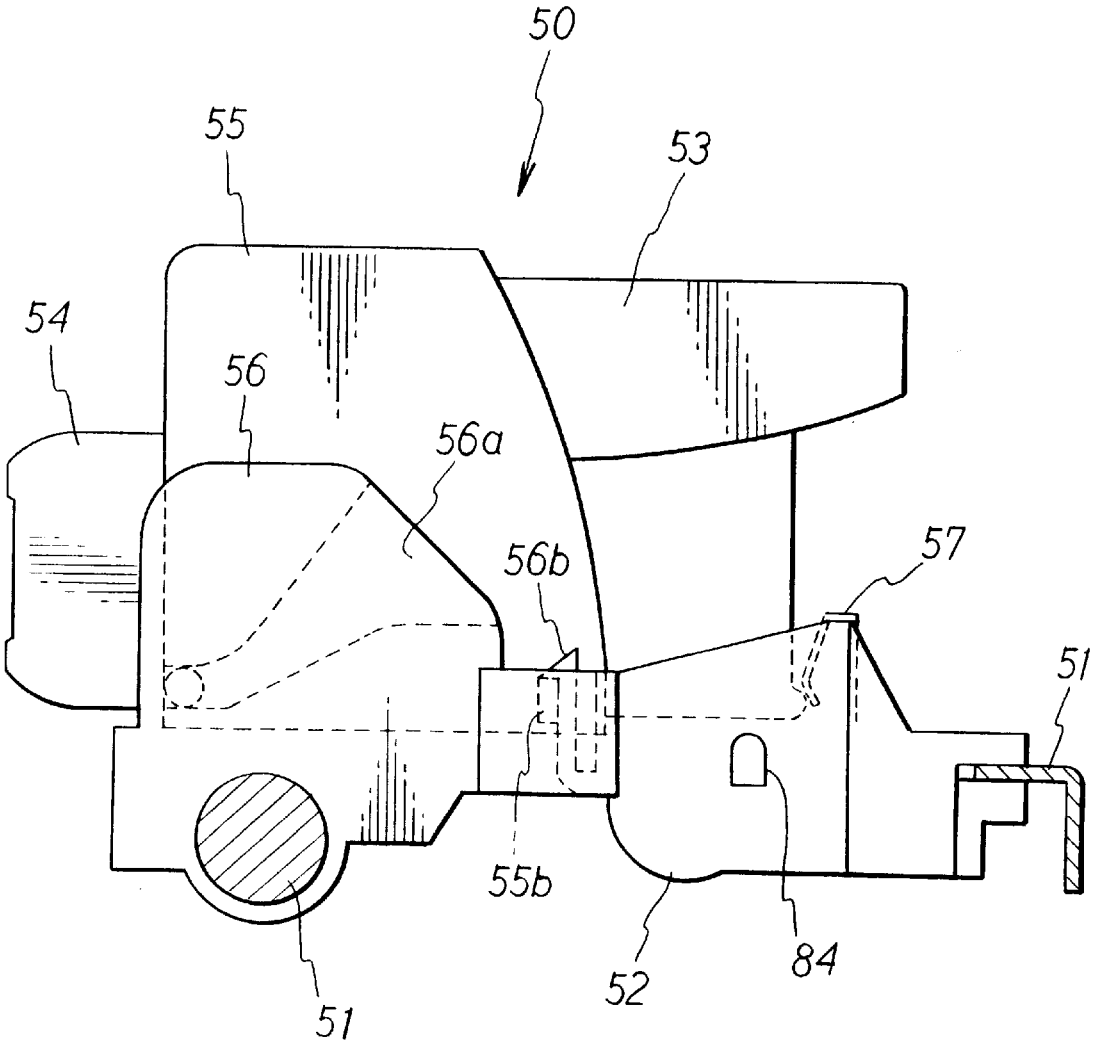
FIG. 9 is an enlarged side view of an area with the carriage, print head and ink cartridge used in the ink jet printer as the embodiment.
Figure 10:
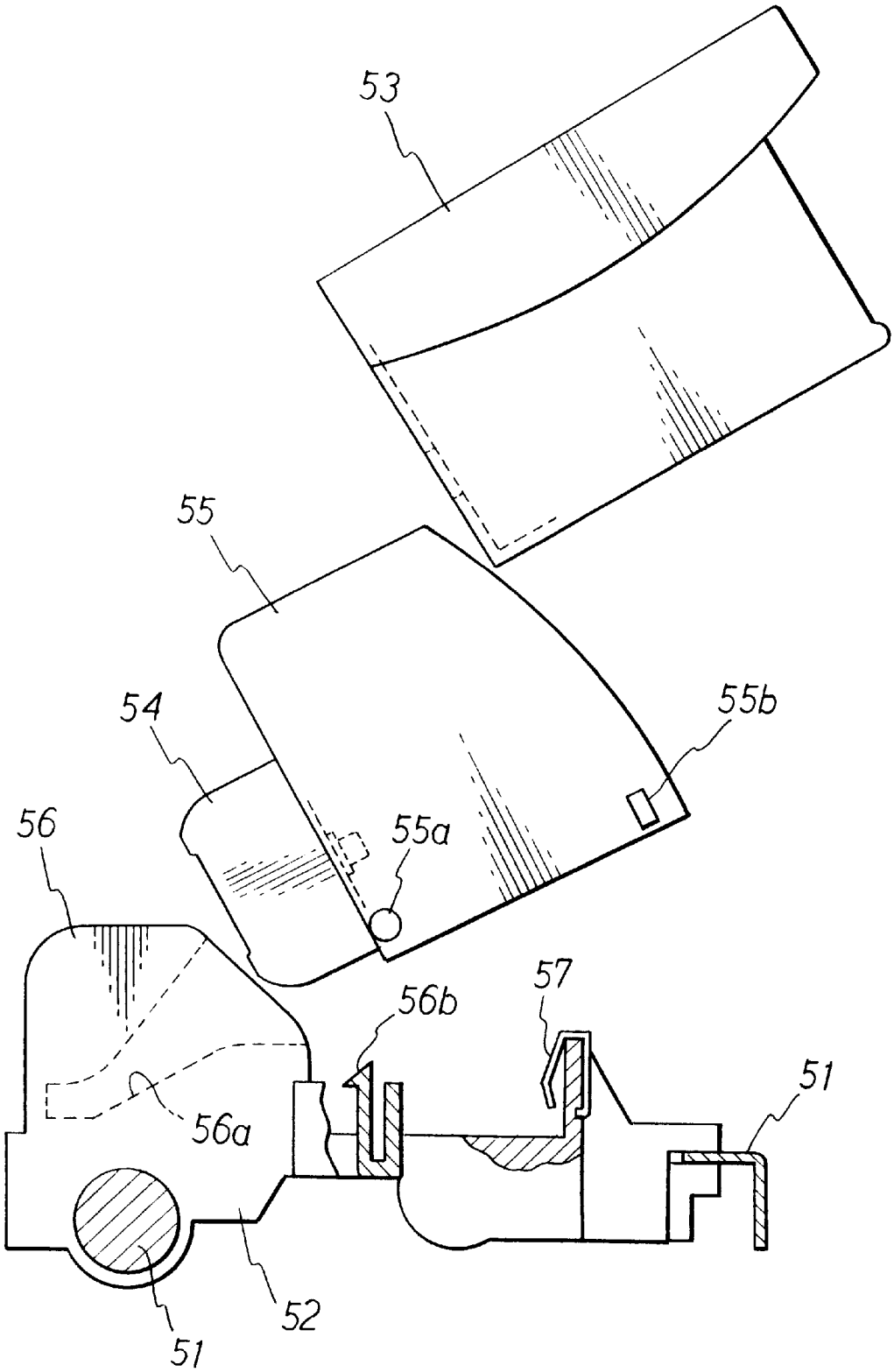
FIG. 10 is an exploded side view of the carriage, print head and ink cartridge in FIG. 9.

As shown in FIGS. 9 and 10, the print head 54 is supported by a box-shaped holder 55 integrally. Protrusions 55*a* provided at front parts of the right and left sides of the holder 55 are fitted into grooves 56*a* of right and left side walls 56 erected from the carriage 52. Whereas protrusions 55*b* provided at rear parts of the right and left sides of the holder 55 are hooked on elastic grippers 56*b* erected from the carriage 52. Thus, the holder 55 is mounted, along with the print head 54, on the carriage 52 detachably. The ink cartridge 53 is inserted into the holder 55 from its behind, and connected so as to be capable of supplying ink to the print head 54. The ink cartridge 53, in its connected condition, is held under pressure by a spring 57.

The box-shaped holder 55 and the grooves 56*a* of the carriage have such shapes as to be open rearward with respect to the print head 54, namely, toward an opening 11 of the outer case 10 (see FIG. 2). Thus, as shown in FIG. 10, the ink cartridge 53 and the print head 54 can be mounted detachably on the carriage 52 through the opening 11 of the outer case (see FIG. 2).

Figure 7:
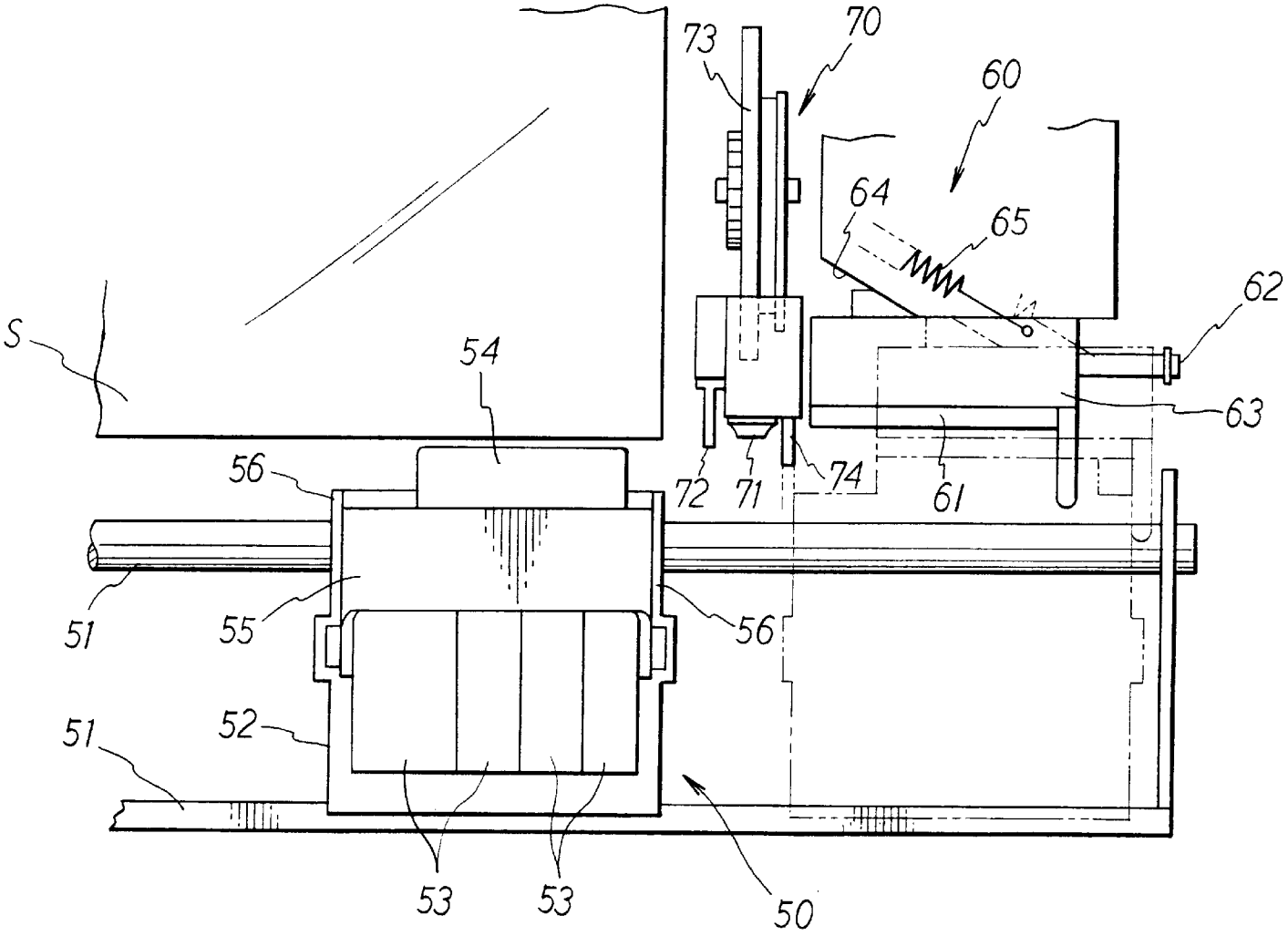
FIG. 7 is a plan view of an area with a protective cap device and a purging device in the ink jet printer of FIG. 1.

FIG. 7 shows the arrangement of a protective cap device 60 and a purging device 70 as viewed in the direction of insertion of the sheets S into the sheet cassette 41. These devices are placed outside the passageway for the printing sheets S and at a position opposed to one of the ends of movement of the carriage 52. The protective cap device 60 has a protective cap 61 for intimately contacting and covering all the ejection nozzles of the print head 54, and a support member 63 for supporting the protective cap and being capable of sliding and swaying along a shaft 62. Assume that the carriage 52 has moved beyond the printing zone for the printing sheet S. The carriage 52 makes contact with a projecting arm 63*a* of the support member 63, and pushes the projecting arm 63*a* rightward in the drawing against the force of the spring 65. As shown by a two-dot chain line in FIG. 7, the support member 63 rocks toward the print head 54 along an inclined cam 64 while sliding together with the carriage 52. As a result, the protective cap 61 covers the print head 54. When the carriage 52 returns to the printing zone, the support member 63 leaves the print head 54 under the action of the inclined cam 64 and the spring 65.

The purging device 70 moves a suction cap 71 toward or away from the guide rails 51 by a cam 73 rotated by a drive source (not shown). Thus, the purging device 70 brings the suction cap 71 into intimate contact with the ink ejection nozzles for a respective color of the print head 54, to suck ink in the nozzles by means of a negative pressure generated by a pump (not shown). The purging device 70 further moves a wiper blade 72 toward or away from the guide rails 51 to wipe the nozzles after suction. In accordance with the rotation of the eccentric cam 73, the purging device 70 moves a stopper 74 toward or away from the guide rails 51, locking or unlocking the carriage 52 to or from the position where the print head 54 is in intimate contact with the protective cap 61.

As shown in FIG. 2, the outer case 10 covering the various devices and mechanisms, as stated previously, has the opening 11 in that transversely elongated area at the top surface thereof which is opposed to the range of movement of the print head 54 and ink cartridges 53 moved with the carriage 52. The opening 11, as shown in FIG. 2, extends over the range of the printing zone where the print head 54 faces the printing sheet, but does not reach the position at which the print head 54 faces the protective cap 60. At the position where the print head 54 faces the protective cap 60, an auxiliary opening 11*a* is formed so as to continue from the opening 11. In the auxiliary opening 11*a*, a cover member 12 is mounted detachably.

Figure 8:
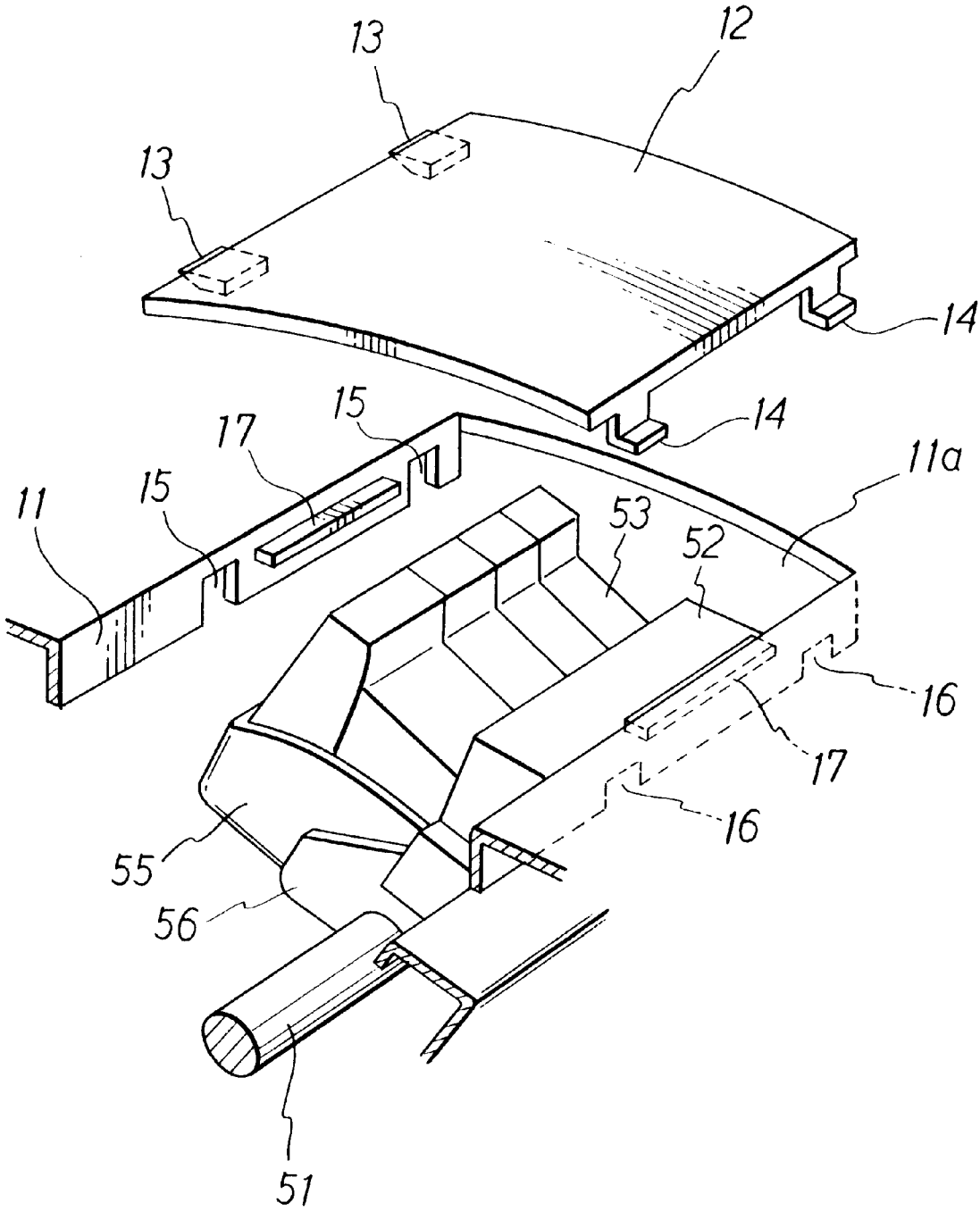
FIG. 8 is a partial enlarged perspective view of the ink jet printer showing a state in which a cover member is removed from an outer case when a carriage holding a print head is located at the position of purging treatment in FIG. 2.

The cover member 12, as shown in FIG. 8, has protrusions 13, 14 on both terminal edges in the front-to-back direction, namely, in the direction in which the cover member 12 bridges the auxiliary opening 11*a*. First, the protrusions 14 are hooked on recesses 16 provided at the inner edges of the auxiliary opening 11*a*, and then the remaining protrusions 13 are hooked on recesses 15 provided at the opposite inner edges of the auxiliary opening 11*a* with the use of the elasticity of the cover member 12 and the outer case 10, whereby the cover member 12 is mounted in place. The cover member 12 is supported by projections 17, 17 provided on the opposite inner edges of the auxiliary opening 11*a* to counter a possible sag. This measure enables the cover member 12 to present the user's hand from accidentally touching the print head 54, ink cartridge 53 and carriage 52 when in the usual state of use the print head 54 lies at a position opposed to the protective cap device 60.

Replacement of the print head 54 involves electrical connection between the print head and a control device to be described later on. Thus, this replacement needs to be performed during the stoppage of printing, namely, when the print head 54 is opposed to the protective cap 61. In this condition, the cover member 12 is detached. Since the auxiliary opening 11*a* continues from the opening 11, the opening 11 is also usable as a space where the hand is inserted for the replacement operation. Furthermore, external light enters through the opening 11, thus making the position of this operation bright and facilitating this operation.

On the top surface of the outer case 10, as shown in FIG. 2, the opening/closing cover 21 is mounted so as to be turnable about hinges 22. The opening/closing cover 21 covers not only the opening 11, but also the surroundings of the opening 11, including the cover member 12, so as to be openable and closable. At those positions on the outer case 10 which are covered with the opening/closing cover 21, manual operation keys 24, 25 for switches are disposed.

Figure 4:
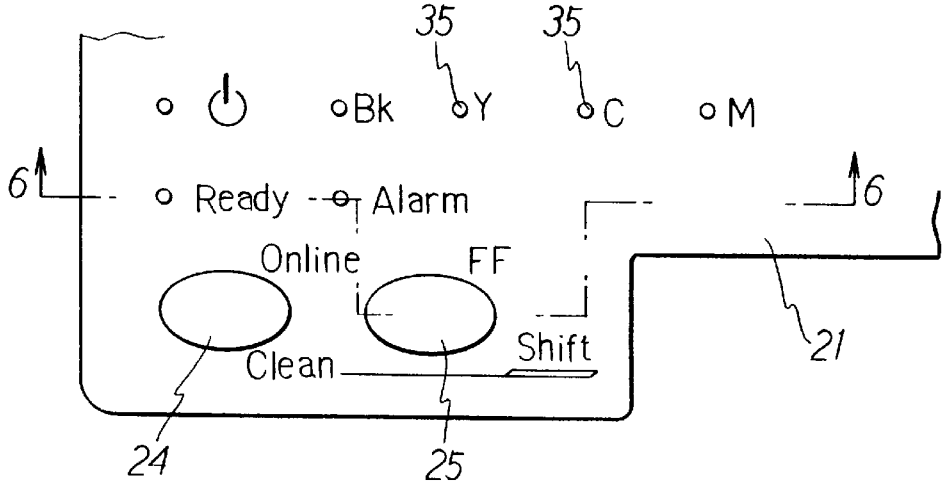
FIG. 4 is a plan view of manual operation keys and a display of the ink jet printer in which the opening/closing cover is closed.
Figure 5:
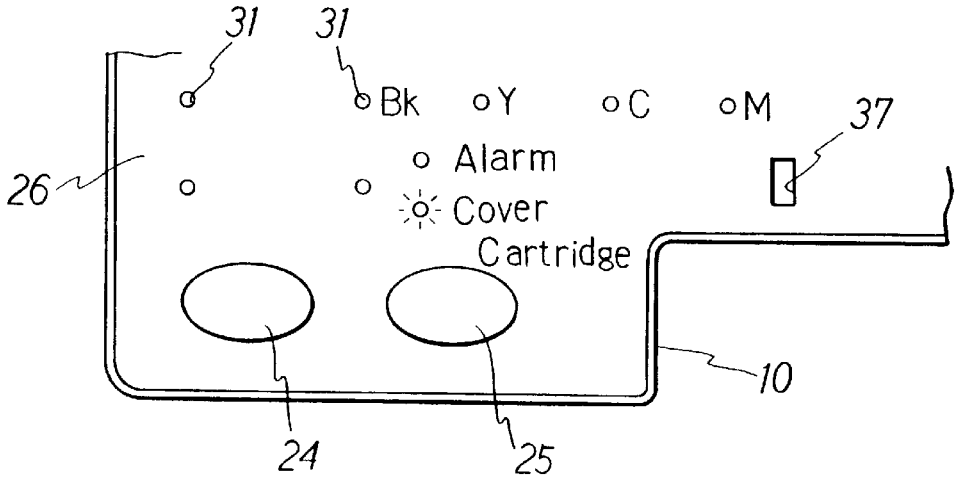
FIG. 5 is a plan view of the manual operation keys and display of the ink jet printer in which the opening/closing cover is opened.
Figure 6:
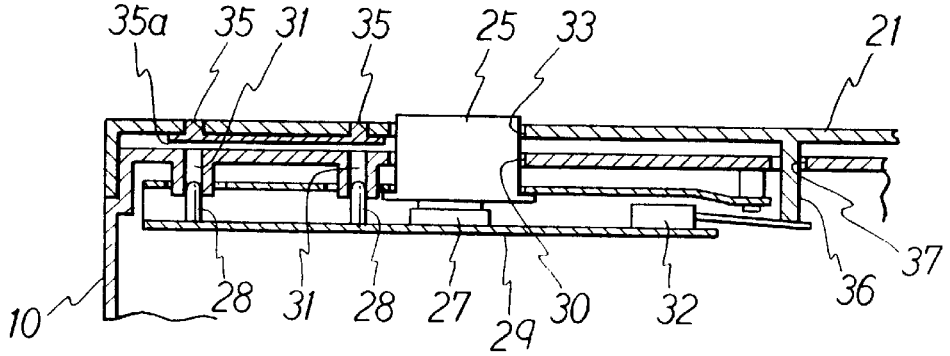
FIG. 6 is a sectional view taken on line 6—6 of FIG. 4.

FIGS. 4 to 6 show the arrangement of the switch area, which comprises the manual operation key 24 for switching between an online state and an offline state, the manual operation key 25 for controlling the feed of the printing sheet and carriage movement to the position of ink cartridge replacement, and a display station 26 showing the on- or off-state of a power supply, the online or offline state, decreases in the remaining amounts of the inks of various colors, and other warnings.

In the outer case 10, switches 27 (only one of them is shown) corresponding to the operation keys 24, 25, and a plurality of display instruments 28, such as light emitting diodes, for the display station 26 are provided on a base plate 29. The operation keys 24, 25 protrude from the top surface of the outer case 10 through holes 30 of the outer case 10, while the display instruments 28 are exposed on the top surface through holes 31. The opening/closing cover 21 also has holes 33, 34 at positions corresponding to the operation keys 24, 25, and a plurality of holes 35 at positions corresponding to the display instruments 28. In the holes 35, transparent members 35*a* for guiding light are inserted.

On the base plate 29, a detector 32, such as a switch, for detecting the opening and closing of the opening/closing cover 21 is provided. When the opening/closing cover 21 is closed, a protrusion 36 on the opening/closing cover 21 enters a hole 37, actuating the detector 32.

Even when the opening/closing cover 21 has been closed, the manual operation keys 24, 25 are exposed through the holes 33, 34. Thus, by turning on the key 24 with the opening/closing cover 21 closed, switching operation between the online state and the offline state can be made under the control of the control device (to be described later on). By turning on the key 25 with the opening/closing cover 21 closed, feeding of the printing sheet for its insertion or discharge can be controlled. By simultaneously pressing both keys, the carriage is moved to its position opposed to the purging device, and a purging treatment for forcing ink to be sucked from the nozzles is carried out. The opening/closing cover 21 is provided with a display for showing the execution of these treatments, as illustrated in FIG. 4. When the opening/closing cover 21 is opened, the detector 32 detects this to switch, under the control of the control device (to be described later on), the function of the switch, corresponding to the manual operation key 25, to the function of moving the carriage for replacement of the ink cartridge. On the outer case 10 covered with the opening/closing cover 21, a display for indicating this switching is made as shown in FIG. 5.

The display instruments 28 can also be seen not only when the opening/closing cover 21 is open, but also when it is closed, through the holes 35.

As shown in FIGS. 2, 4, 5 and 6, the displays Bk, Y, C and M near the holes 35, 31 on the opening/closing cover 21 and the display station 26 are provided in the same order as the order of arrangement of the ink cartridges carried on the carriage. The holes 35, 31 and the light guiding members 35*a* are provided with the same spacing as the spacing between the ink cartridges placed on the carriage.

When ink of any of the colors of the ink cartridges on the carriage is used up, the light guiding member 35*a* blinks or lights up that corresponds to the color of the exhausted ink among the light guiding members 35*a* provided at the positions corresponding to the holes 35, 31 provided in correspondence with the respective colors Bk, Y, C and M.

For replacement of the ink cartridge, the carriage is moved from the home position, where the carriage faces the protective cap, to a site in the printing zone. At this time, the carriage is brought to the position where the cartridges of the respective colors correspond to the light guiding members 35*a* provided through the holes 31 and the displays Bk, Y, C and M provided on the display station 26. As a result, the cartridges of the respective colors are situated at the positions corresponding to the displays Bk, Y, C and M on the display station 26. At these corresponding positions, the light guiding member 35*a* corresponding to the color of the exhausted ink is blinking or lighting up. Thus, the user can easily know which of the ink cartridges should be replaced. This prevents the user from replacing the wrong ink cartridge.

Figure 11:
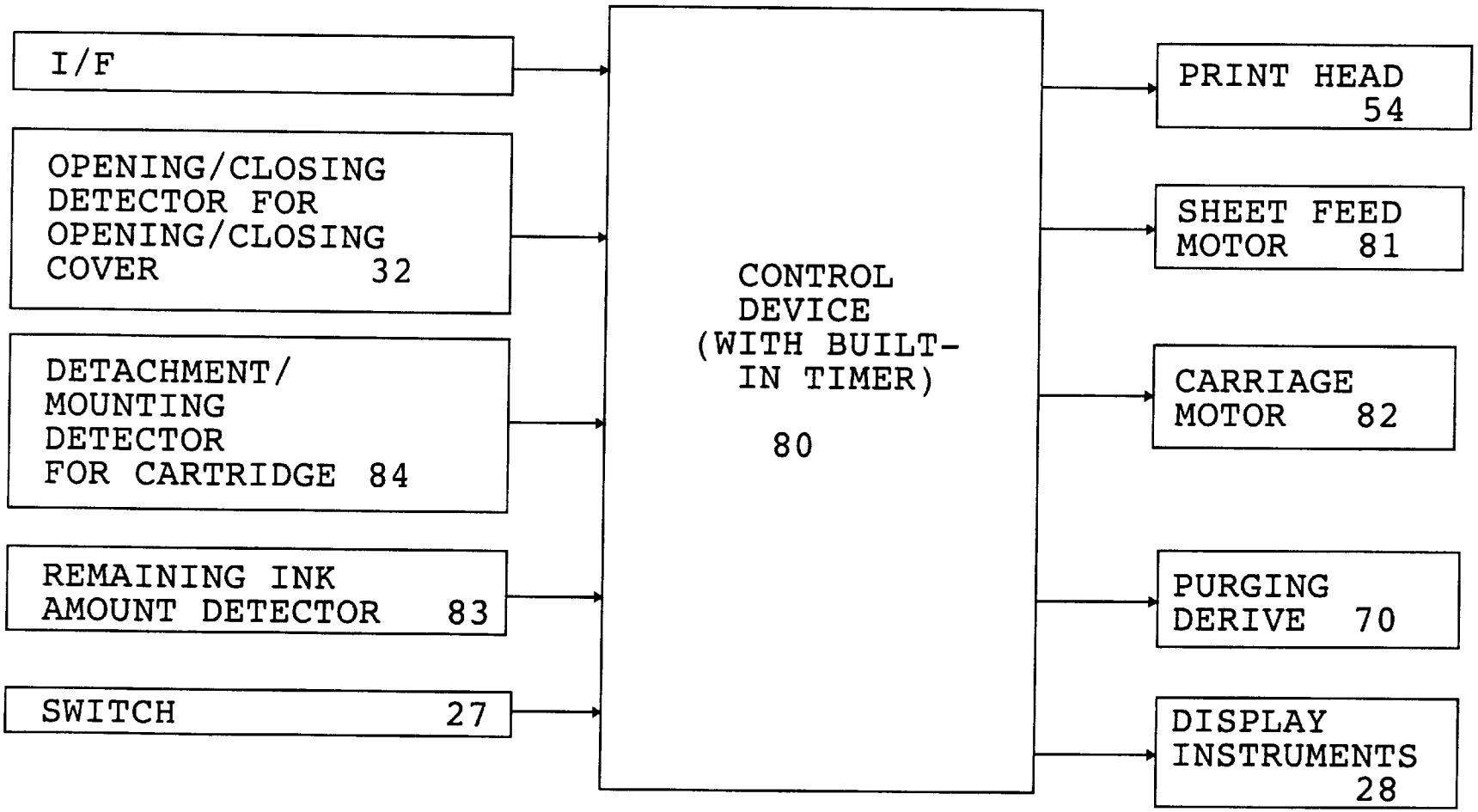
FIG. 11 is a block diagram schematically showing the electrical configuration of the ink jet printer.

FIG. 11 shows the outlined electrical configuration of the inventive printer. A control device 80 is a control circuit composed of CPU, ROM, RAM and a hardware logic which are known. Based on data received through an I/F, the control device 80 controls the print head 54, a sheet feed motor 81 as a drive source for the feeding mechanism 40, and a carriage motor 82 as a drive source for the reciprocating movement of the carriage 52, thereby performing a print action. The control device 80 also receives signals from the switch 27, detector 32 for the opening/closing cover, and ink cartridge detachment/mounting detectors 84 (see FIG. 9) and remaining ink amount detectors 83 provided on the carriage 52 for the respective ink cartridges. Based on these signals, the control device 80 controls the purging device 70 and the display instruments 28, including the above-mentioned control for a print action. The detachment/mounting detectors 84 and remaining ink amount detectors 83 are composed of known switches or electrical contacts. The display instruments 28 are also provided for the respective ink cartridges.

Figure 12A:
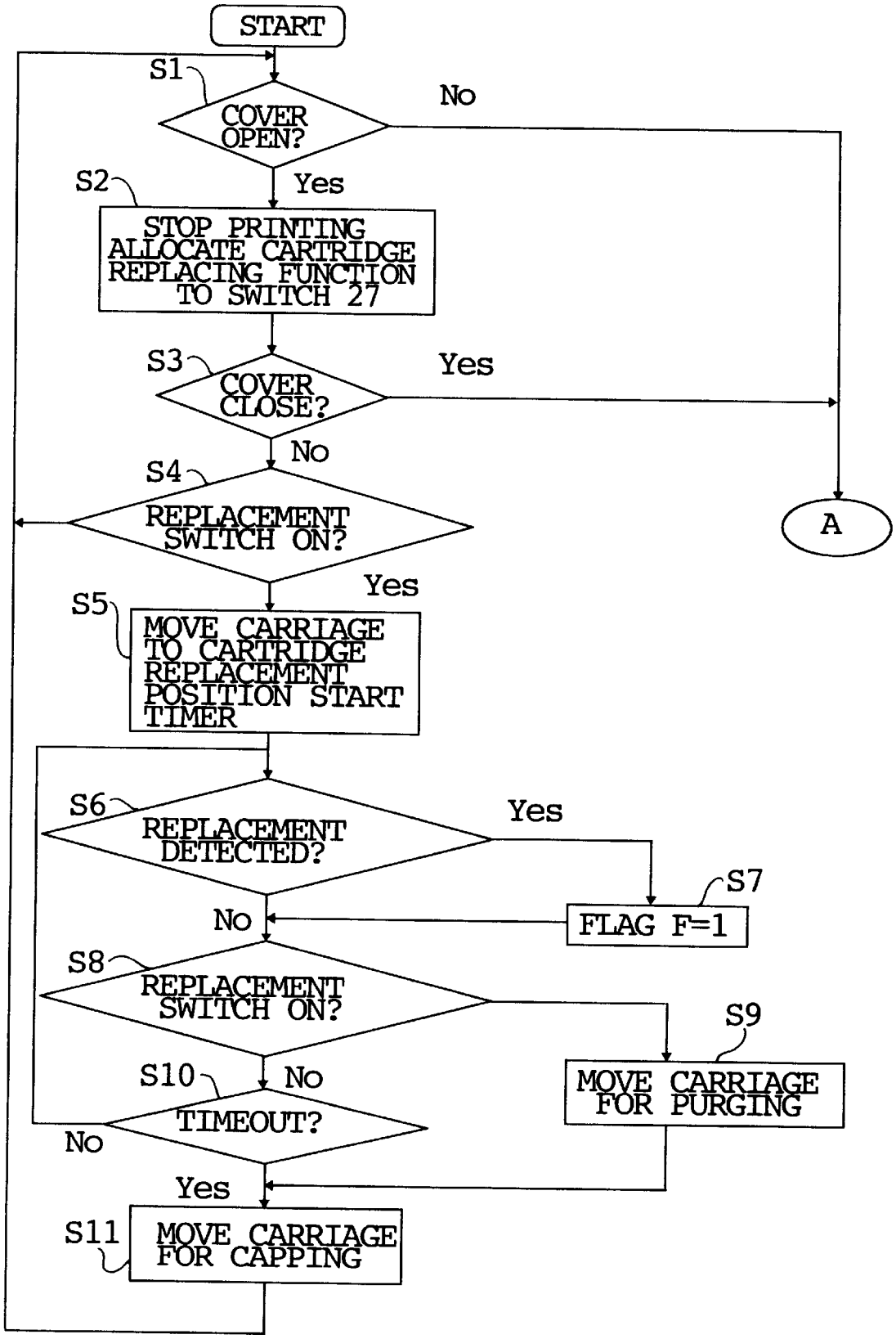
FIGS. 12A and B are a flow chart showing details of control by a control device for performing a purging treatment in accordance with the opening and closing of the opening/closing cover.
Figure 12B:
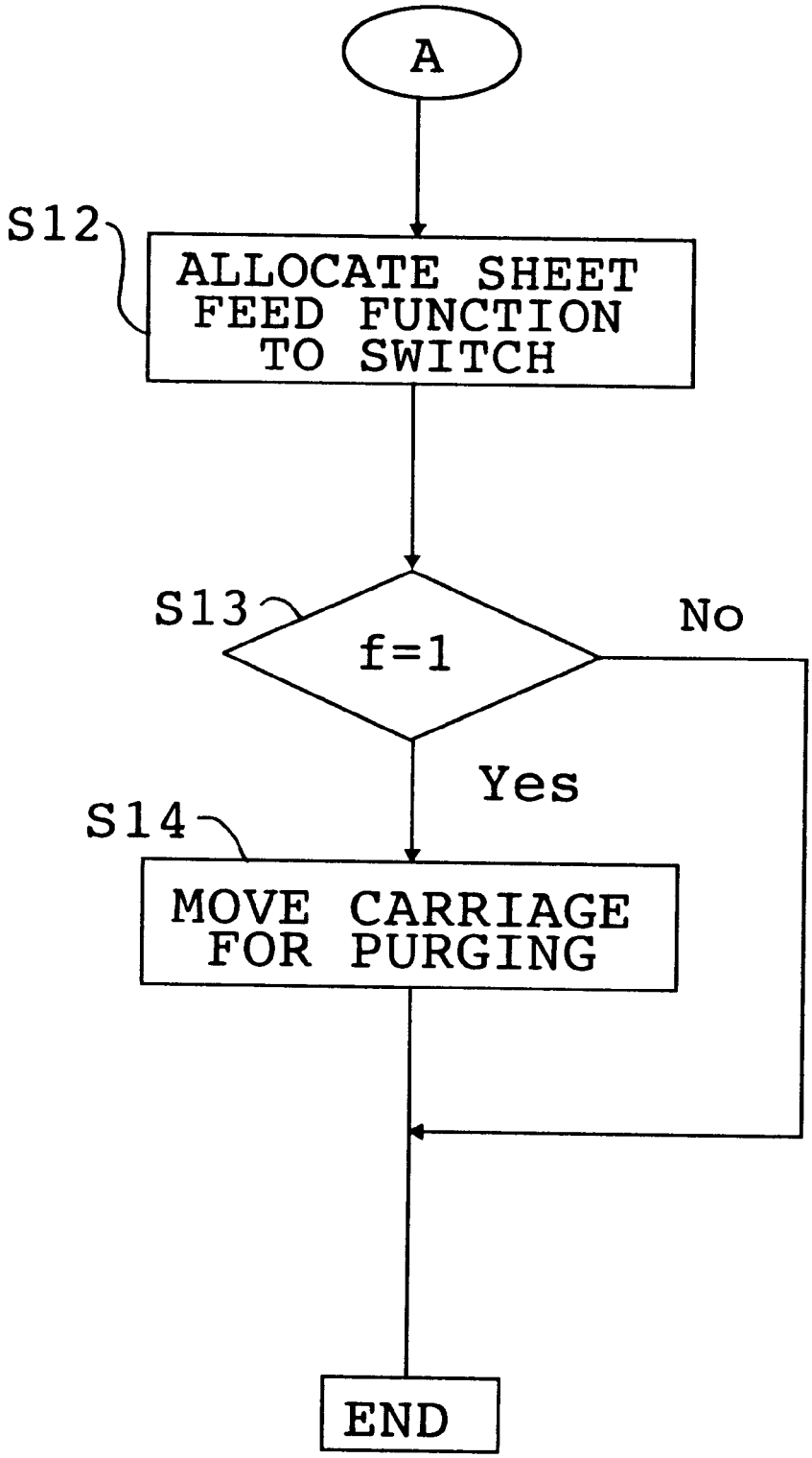

FIG. 12 is a flow chart showing details of control by the control device 80 associated with the opening and closing of the opening/closing cover 21. When the opening/closing cover 21 is opened (S1: Yes), the control device 80 stops a print action if printing is being done. The control device 80 also moves the carriage 52 to a position where the print head 54 is covered with the protective cap 61. The control device 80, moreover, drives the drive source for the purging device 70 slightly to protrude the stopper 74, locking the carriage at this position (S2). If printing is not being done, the carriage is already at the same position. At this position, the carriage 52 is covered at the top with the cover member 12. Simultaneously with the opening of the opening/closing cover 21, the control device 80 changes the function of the switch 27 corresponding to the manual operation key 25, and allocates to the switch 27 the function of moving the carriage 52 to the position where the ink cartridge is replaced.

Then, the control device 80 monitors the opening/closing of the opening/closing cover 21, and the operation of the switch 27. When the user turns on the switch 27 (S4: Yes) with the manual operation key 25 without immediately closing the opening/closing cover 21 (S3: No), the control device 80 drives the carriage motor 82. Thus, the carriage 52 is moved to the position of ink cartridge replacement as indicated by a two-dot chain line in FIG. 2, i.e., a predetermined position in an area opposed to the opening 11, and the timer in the control device is caused to start a time measuring action (S5). The predetermined position may be an arbitrary position in this area.

Assume, in this condition, replacement of the ink cartridge is not performed (S6: No), the switch 27 is not turned on with the manual operation key 25 (S8: No), and the predetermined time to be measured by the timer (say, 5 minutes) has passed (S10: Yes). In this case, the control device 80 moves the carriage 52 to the position where the protective cap 61 covers the print head 54 (S11), thereby preventing the drying of the print head 54.

When a predetermined ink cartridge 53 is detached from the carriage and replaced by a fresh one, the detachment/mounting detector 84 on the carriage 52 detects this (S6: Yes), and the control device 80 sets a flag f=1 (S7). When, on this occasion, the manual operation key 25 is not operated (S8: No), and the timer has measured a predetermined time (S10: Yes), the control device 80 moves the carriage 52 to a position where the protective cap 61 covers the print head 54 (S11). When the switch 27 is turned on (S8: Yes) with the manual operation key 25 after replacement of ink cartridge 53, the carriage 52 is moved to the position opposed to the purging device under the control of the control device 80. There, a purging treatment is performed (S9) for sucking ink from each nozzle and guiding ink of the fresh cartridge to the print head 54. Then, the carriage 52 is moved to the position where the print head 54 is covered with the protective cap 61 (S11). If it is desired to start a print action as soon as the ink cartridge 53 is replaced, the manual operation key 25 is used to turn on the switch 27. If this is not desired, the user waits for the timer to have measured the predetermined time, and then enters into a subsequent action (the state "No" in S8).

When the opening/closing cover 21 is in a closed state (S1: No), or the opening/closing cover 21 is closed after it is opened (S3: Yes), the control device 80 changes the function of the switch 27 corresponding to the manual operation key 25, and allocates a sheet feed function to it (S12). When the opening/closing cover 21 is closed after replacement of the ink cartridge 53, the flag f=1 has been set (S13: Yes). Thus, the control device 80 moves the carriage 52 to the position where it faces the purging device, and performs a purging treatment for sucking ink from each nozzle and guiding ink of the fresh cartridge to the print head 54 (S14). The purging is performed at this step in the case where it is not carried out after replacement of the ink cartridge 53 (S8: No, S10: Yes).

When the opening/closing cover 21 is closed without replacement of the ink cartridge 53, the flag f=1 has not been set (S13: No). Thus, the control device 80 returns to the main printing routine without performing a purging treatment.

During the closure of the opening/closing cover 21, it is possible to perform a print action while moving the carriage 52 along the printing sheet in accordance with the print data; or to operate the manual operation key 25, thereby doing sheet feed such as insertion or discharge of the printing sheet under the control of the control device 80. The function allocated to the switch 27 corresponding to the manual operation key 25 when the opening/closing cover 21 is closed may be a function originally required of the printer, such as switching between the online state and the offline state.

When the opening/closing cover 21 is opened, the manual operation key 25 is operated to move the carriage from that position outside one end of the opening 11 at which the carriage is covered with the cover member 12 to the position at which the carriage is opposed to the opening. During rest of the printer, therefore, the carriage 52 is covered with the cover member 12 at the position where the ink ejection nozzles of the print head 54 are covered with the protective cap. This prevents the accidental movement of the carriage that would cause the drying of the print head. Furthermore, the opening/closing cover 21 must be opened when replacing the ink cartridge 53. On condition that its opening has been detected, the function of the manual operation key 25 that normally functions otherwise can be switched to move the carriage 52 to the position of ink cartridge replacement. Thus, the wrong operation is minimized, and the intended action can be performed using a few keys.

At positions on the opening/closing cover 21 and on the outer case 10 covered by the opening/closing cover 21, displays are made of the functions that the manual operation key 25 can perform. When the opening/closing cover 21 is closed or open, the desired action can be implemented easily according to the relevant display. The opening/closing cover 21 may have a length not reaching the keys 24, 25, and only displays of the functions of these keys may be provided on the opening/closing cover 21 and on the outer case 10 covered by the opening/closing cover 21.

The display instruments 28 which show the remaining amount of ink can be seen through the holes 31 whether the opening/closing cover 21 is open or closed. Even after the opening/closing cover 21 is opened, therefore, the user can notice storage of little ink, thus facilitating the replacement of the cartridge. With the inventive printer having the plurality of ink cartridges, in particular, the user can confirm the type of ink cartridge to be replaced, even when the opening/closing cover 21 is open. Thus, the wrong ink cartridge is not replaced. In the instant embodiment, the opening/closing cover 21 is provided with the holes 31 corresponding to the display instruments 28. However, the display instruments 28 may be located at positions not covered with the opening/closing cover 21 so that they can be seen regardless of the opening or closing of the opening/closing cover 21.

In the above-described embodiment, the ink cartridge detachment/mounting detectors 84 and steps S6 and S7 of FIG. 12 may be omitted. In this case, after the manual operation key 25 is operated at S4, the closure of the opening/closing cover 21 may result in a purging treatment without fail.

What is claimed is:

1. An ink jet printer, comprising:

an ink jet print head with detachable ink cartridges;

a carriage holding the print head and movable along the surface of a printing sheet;

an outer case containing said ink jet printhead and said carriage which accommodates the carriage over the range of its movement, and having an opening for detachment of the ink cartridge from the carriage and mounting of a new ink cartridge thereon, the opening being formed in the outer case such that the opening is opposed to a part of the range of movement of the carriage;

an opening/closing cover mounted on the outer case for covering the opening of the outer case;

a control device connected to the carriage for controlling the actions of the ink jet printer;

a first detector connected to the control device for detecting the opening and closing of the opening/closing cover; and a manual operation key supported by the outer case for entering an action signal for the ink jet printer into the control device; wherein two or more action modes are allocated to the manual operation key, and the control device switches the action modes of the manual operation key in response to a detection signal from the first detector which shows the opening or closing of the opening/closing cover;

the carriage is movable between a region opposed to the opening formed in the outer case and a part covered with the outer case; and when the opening/closing cover is open, the action mode of the manual operation key is assigned an action for moving the carriage from the region covered with the outer case into the region opposed to the opening.

2. The ink jet printer of claim 1, wherein when the opening/closing cover is closed, the control device allocates a sheet feed action to the action mode of the manual operation key.

3. The ink jet printer of claim 1, wherein while the ink jet printer is not performing a print action, the carriage is on standby or at a standstill in the region covered with the outer case; and when the operation key is turned on while the opening/closing cover is open, the carriage is moved from the region covered with the outer case into the region opposed to the opening, where the ink cartridge is replaced.

4. The ink jet printer of claim 1, which further includes a purging device having a cap making intimate contact with the print head, said purging device being located opposite said part covered with the outer case.

5. The ink jet printer of claim 4, wherein when the operation key, assigned the action for moving the carriage from the region covered with the outer case into the region opposed to the opening during the opening of the opening/closing cover, is turned on, the control device switches the operation key to the action mode for moving the carriage into the part covered with the outer case and then performing a purging operation by the purging device.

6. The ink jet printer of claim 4, which further includes a third detector connected to the control device for detecting the detachment of the ink cartridge and mounting of a new ink cartridge, and wherein the control device controls the purging device so as to suck ink from the ejection nozzles of the print head, provided that the first detector has detected the closing of the opening/closing cover.

7. The ink jet printer of claim 4, which further includes a third detector connected to the control device for detecting the detachment of the ink cartridge and mounting of a new ink cartridge, and wherein the control device controls the purging device so as to suck ink from the ejection nozzles of the print head, provided that the third detector has detected the detachment of the ink cartridge and mounting of the new ink cartridge, and the first detector has detected the closing of the opening/closing cover.

8. The ink jet printer of claim 4, wherein the control device has a timer, and performs control such that when the timer has measured a predetermined time after the carriage is moved by the operation key from the part covered with the outer case to the region opposed to the opening, the carriage is moved to the position opposed to the purging device, whereby the nozzles of the print head are covered with the cap of the purging device.

9. The ink jet printer of claim 4, wherein the outer case includes an openable/closable cover member which covers the part covered with the outer case, the openable/closable cover member being positioned below the opening/closing cover when both the openable/closable cover member and the opening/closing cover are closed.

10. The ink jet printer of claim 1, wherein a through hole is formed at a position of the opening/closing cover which position corresponds to the operation key so that the user can operate the operation key even when the opening/closing cover is in a closed state.

11. The ink jet printer of claim 10, wherein the action mode of the operation key when the opening/closing cover is in a closed state is displayed on the opening/closing cover, while the action mode of the operation key when the opening/closing cover is in an open state is displayed on the outer case.

12. The ink jet printer of claim 1, which further includes a second detector connected to the control device for detecting the remaining amount of ink in the ink cartridge, and a display instrument supported by the outer case for displaying the results of detection by this detector on the outer case, and wherein a see-through hole is formed at that position of the opening/closing cover which corresponds to the display instrument so that a display of the display instrument can be seen even when the opening/closing cover is closed.

13. The ink jet printer of claim 12, which is a color ink jet printer, and includes a plurality of ink cartridges, print heads, second detectors and display instruments corresponding to the colors of ink.

14. The ink jet printer of claim 1, wherein a portion of the outer case which corresponds to the region covered with the outer case in the region of movement of the carriage is composed of an openable/closable cover member.

* * * * *